US010888490B1

(12) United States Patent
Vorobets

(10) Patent No.: US 10,888,490 B1
(45) Date of Patent: Jan. 12, 2021

(54) SCALP MASSAGER

(71) Applicant: Lyudmila Vorobets, University Place, WA (US)

(72) Inventor: Lyudmila Vorobets, University Place, WA (US)

( * ) Notice: Subject to any disclaimer, the term of this patent is extended or adjusted under 35 U.S.C. 154(b) by 406 days.

(21) Appl. No.: 15/871,228

(22) Filed: Jan. 15, 2018

(51) Int. Cl.
*A61H 7/00* (2006.01)

(52) U.S. Cl.
CPC ..... *A61H 7/005* (2013.01); *A61H 7/007* (2013.01); *A61H 2201/0153* (2013.01); *A61H 2205/021* (2013.01)

(58) Field of Classification Search
CPC ..... A61H 2205/021
See application file for complete search history.

(56) References Cited

U.S. PATENT DOCUMENTS

D438,978 S 3/2001 Conwell
6,450,980 B1 9/2002 Robbins
D488,231 S 4/2004 Sorlie
7,153,282 B1 * 12/2006 Dudley ..... A61H 7/004 601/93
7,399,287 B2 7/2008 Meisch
2003/0208144 A1 11/2003 Sorlie
2004/0049138 A1 * 3/2004 Li ..... A61H 7/005 601/137
2005/0020944 A1 * 1/2005 Friedland ..... A61H 7/003 601/1
2005/0043656 A1 2/2005 Lacey
2012/0121313 A1 5/2012 Thiebaut
2014/0107543 A1 * 4/2014 Pazouki ..... A61H 7/005 601/72
2014/0202493 A1 * 7/2014 Zelickson ..... A61B 17/32 134/6

FOREIGN PATENT DOCUMENTS

WO 1979000974 11/1979

* cited by examiner

*Primary Examiner* — Bradley H Philips
*Assistant Examiner* — Savannah L Gabriel

(57) ABSTRACT

The scalp massager comprises a motorized hub that is mechanically linked to a plurality of radial arms. A massage ball at the end of each radial arms pressed against the scalp and the oscillatory motion of the radial arms causes the massage balls to move in a complex pattern. The arms comprise bent rods made from a resilient material that provides the springiness necessary to press the massage balls against the scalp. The oscillatory motion is provided by a battery-driven electrical motor located within the hub. A dial on the hub allows the user to turn the motor on or off and to control the speed of the motor.

15 Claims, 4 Drawing Sheets

SCALP MASSAGER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of massage therapy, more specifically, a scalp massager.

SUMMARY OF INVENTION

The scalp massager comprises a motorized hub that is mechanically linked to a plurality of radial arms. A massage ball at the end of each radial arms pressed against the scalp and the oscillatory motion of the radial arms causes the massage balls to move in a complex pattern. The arms comprise bent rods made from a resilient material that provides the springiness necessary to press the massage balls against the scalp. The oscillatory motion is provided by a battery-driven electrical motor located within the hub. A dial on the hub allows the user to turn the motor on or off and to control the speed of the motor.

An object of the invention is to provide scalp massage comprising a central hub, a plurality of radial arms, and a massage ball at the distal end of each arm.

Another object of the invention is to provide a battery-driven motor within the hub that causes the radios arms to move the massage balls.

A further object of the invention is to provide a control to turn the motor on and off.

Yet another object of the invention is to provide a speed control for the motor.

These together with additional objects, features and advantages of the scalp massager will be readily apparent to those of ordinary skill in the art upon reading the following detailed description of the presently preferred, but nonetheless illustrative, embodiments when taken in conjunction with the accompanying drawings.

In this respect, before explaining the current embodiments of the scalp massager in detail, it is to be understood that the scalp massager is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the scalp massager.

It is therefore important that the claims be regarded as including such equivalent construction insofar as they do not depart from the spirit and scope of the scalp massager. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
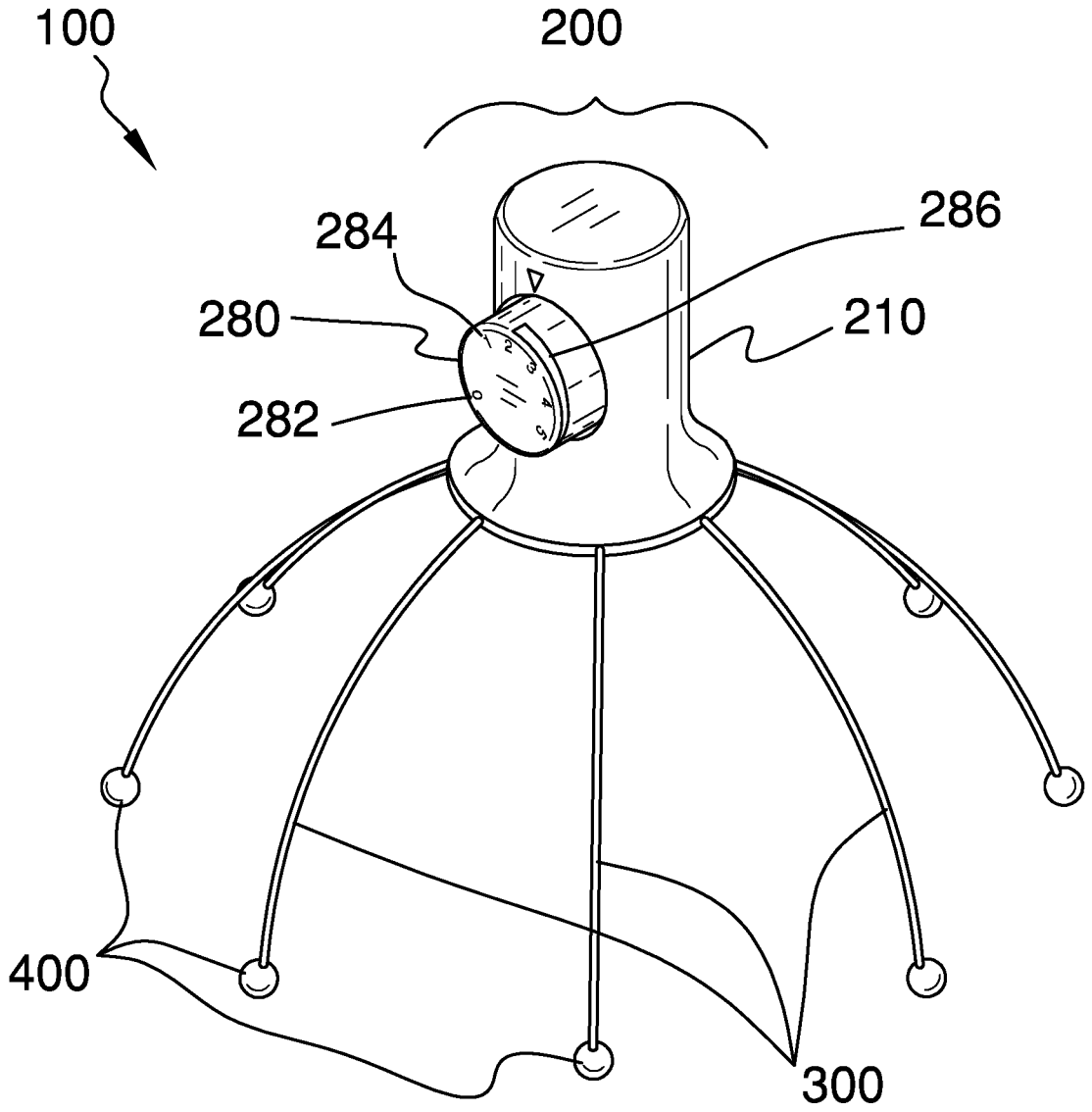
FIG. 1 is a perspective view of an embodiment of the disclosure.
Figure 2:
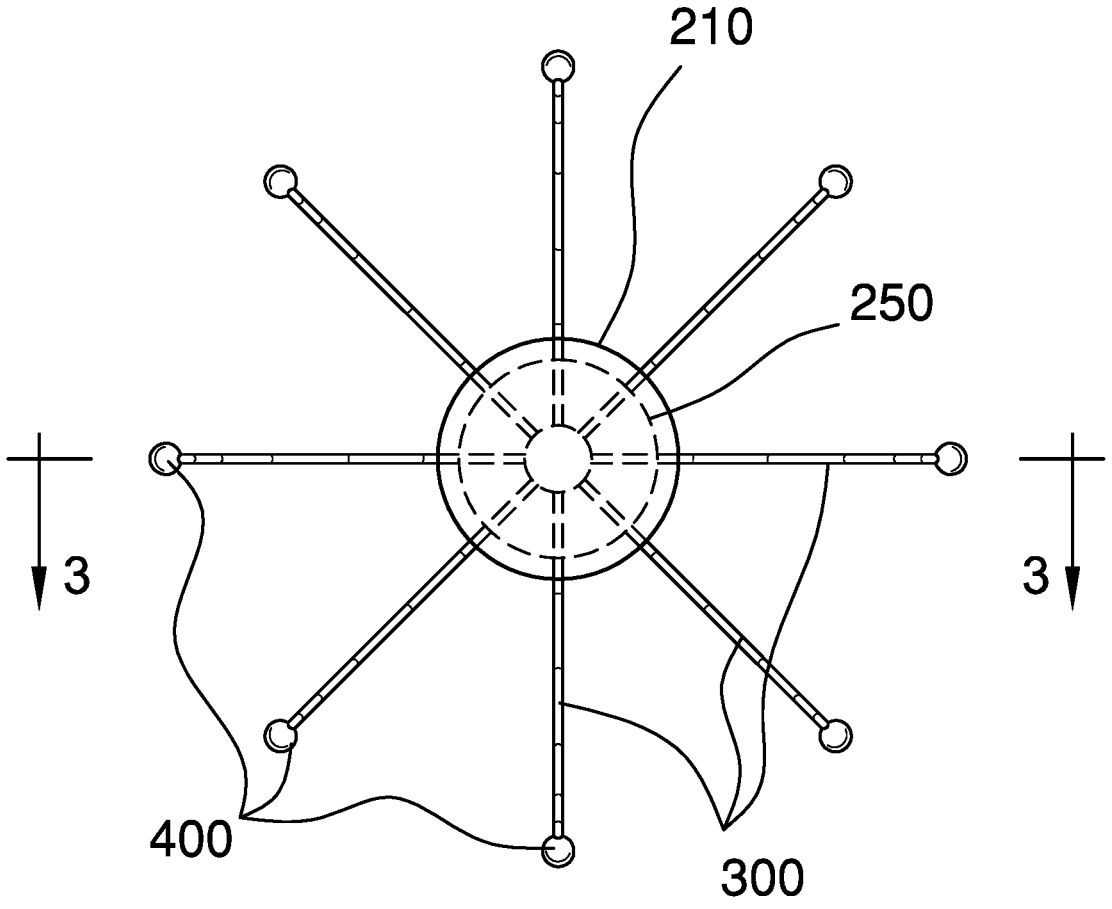
FIG. 2 is a bottom view of an embodiment of the disclosure.
Figure 3:
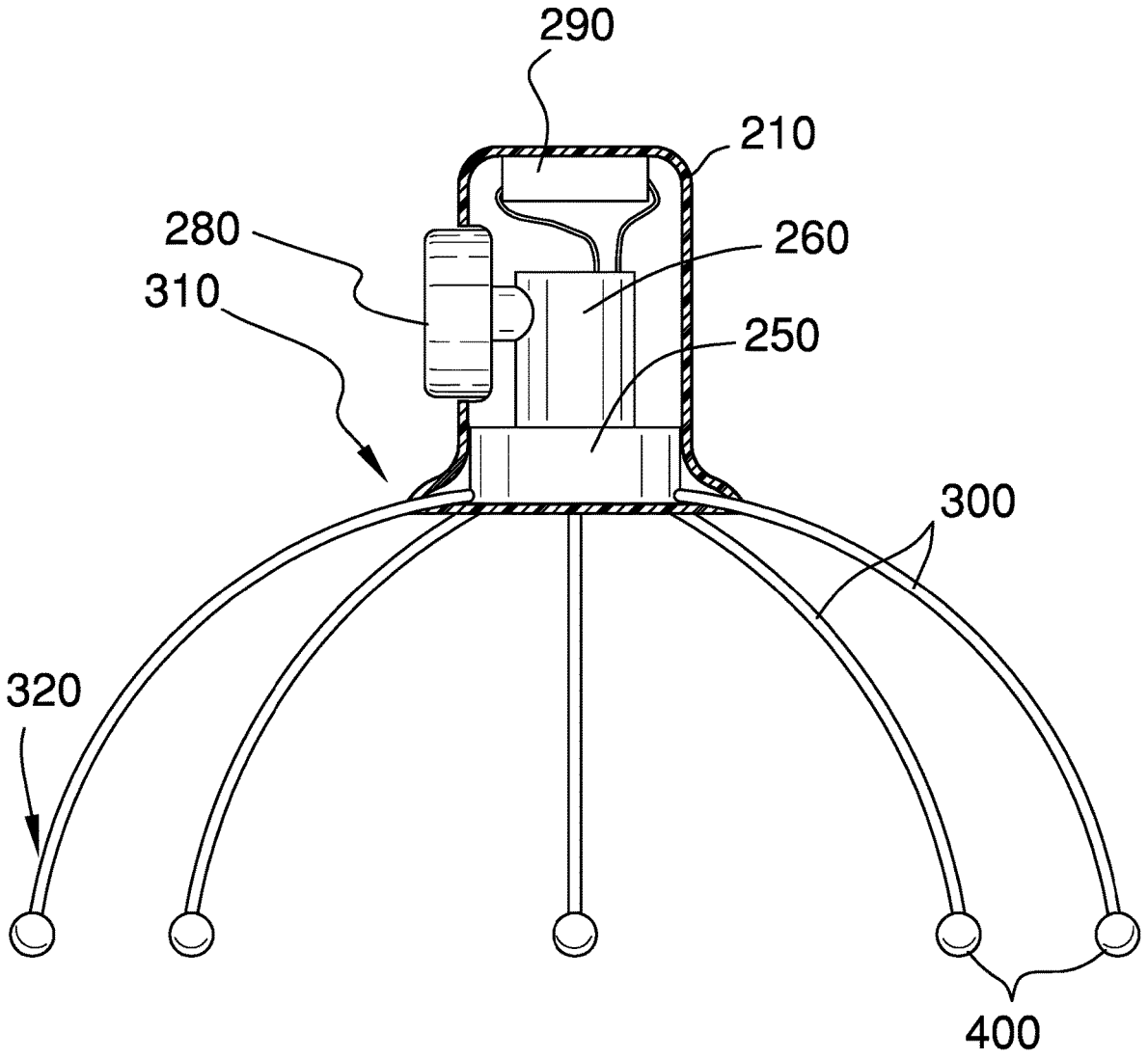
FIG. 3 is a cross-sectional view of an embodiment of the disclosure across 3-3 as shown in FIG. 2.
Figure 4:
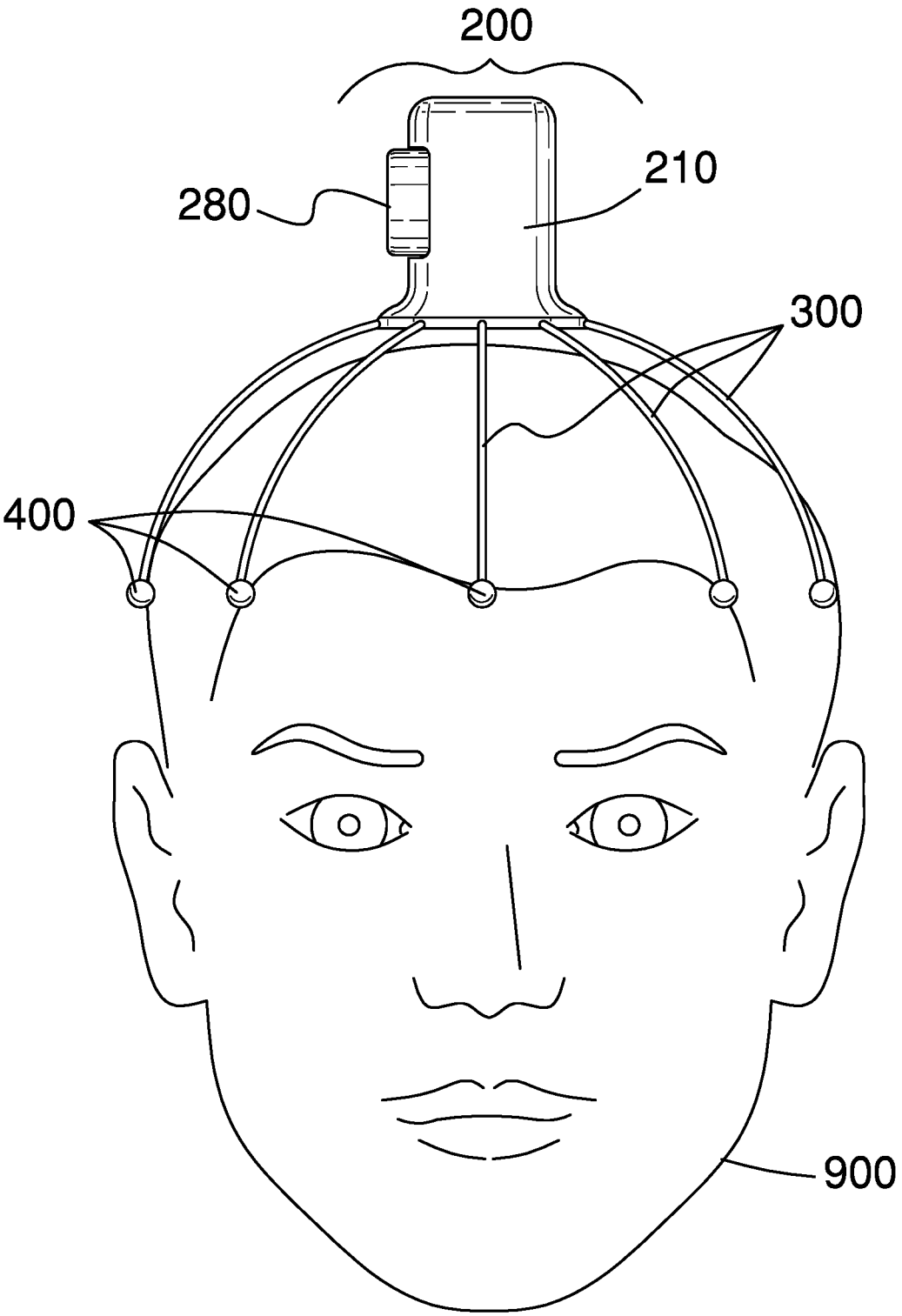
FIG. 4 is a side view of an embodiment of the disclosure while in use.

Detailed reference will now be made to a first potential embodiment of the disclosure, which is illustrated in FIGS. 1 through 4.

The scalp massager 100 (hereinafter invention) comprises a hub 200, a plurality of arms 300, and a plurality of massage balls 400. The hub 200 produces an oscillatory motion of the plurality of massage balls 400 located at the ends of the plurality of arms 300. The invention 100 is placed on a head 900 of a user and the oscillatory motion of the plurality of massage balls 400 helps relieve stress and improves circulation within a scalp of the user.

The hub 200 comprises a housing 210, an electric motor 260, a control dial 280, a vibrator 250, and one or more batteries 290. The hub 200 lies at the center of the invention 100 with the plurality of arms 300 extending radially from the side of the hub 200 at the bottom of the housing 210. The hub 200 is intended to be placed on the top, center of the head 900.

The housing 210 is a protective cover for the electric motor 260, the vibrator 250, and the one or more batteries 290 which are coupled to the inside of the housing 210. As viewed from above, the housing 210 may be round so as to be easily grasped by the user.

The electric motor 260 converts electrical energy provided by the one or more batteries 290 into a rotary motion of a motor shaft (not illustrated in the figures) when the electric motor is energized. The motor shaft is coupled to the vibrator 250. The electric motor 260 is energized when the control dial 280 is moved from an off position 282 to an on position 284. The electric motor 260 is de-energized when the control dial 280 is moved from the on position 284 to the off position 282. The on position 284 of the control dial 280 may be subdivided into a plurality of speed settings 286. As a non-limiting example, the control dial 280 may be marked 0 through 5 where 0 corresponds to the off position 282 and 1 through 5 are the on positions 284 with 1 corresponding to the slowest speed of the electric motor 260, 5 corresponding to the fastness speed of the electric motor 260, and each number between 1 and 5 corresponding to a unique and ordered speed of the electric motor 260.

In some embodiments, the electric motor 260 may comprise a timer circuit (not illustrated in the figures) that causes the electric motor 260 to be de-energized at the end of a predetermined interval. The predetermined interval may begin when the control dial 280 is moved from the off position 282 to the on position 284.

The one or more batteries 290 may provide electrical energy used to power the electric motor 260. The one or more batteries 290 may be mounted within the housing 210. In some embodiments, the one or more batteries 290 may be accessible via a battery compartment door (not illustrated in the figures) to allow replacement of the one or more batteries 290.

The one or more batteries 290 may be rechargeable. As non-limiting examples, the one or more batteries 290 may be recharged by removing the one or more batteries 290 from the hub 200 and placing them into an external battery charger (not illustrated in the figures), by coupling an external power adapter (not illustrated in the figures) to a recharging plug (not illustrated in the figures) that is accessible on the housing 210, or by placing the invention 100 on a recharging mat (not illustrated in the figures) where an inductive coupler (not illustrated in the figures) located within the housing 210 receives energy that is magnetically coupled between the recharging mat and the inductive coupler.

A proximal end 310 of each of the plurality of arms 300 is pivotally coupled to the vibrator 250. The vibrator 250 translates rotary motion of the motor shaft into the oscillatory motion of the plurality of massage balls 400 by moving the proximal end 310 of the plurality of arms 300. The vibrator 250 may move the proximal end 310 of each of the plurality of arms by pushing the proximal end 310 out, pulling the proximal end 310 in, lifting the proximal end 310, dropping the proximal end 310, rocking the proximal end 310 side-to-side, or a combination thereof.

The plurality of arms 300 may be flexible and resilient rods that couple at the proximal end 310 to the vibrator 250 and at a distal end 320 to the plurality of massage balls 400. The length of each of the plurality of arms 300, if straightened, may be between 3 inches and 8 inches. Each of the plurality of arms 300 may be bent into a curve such that when the hub 200 is in place upon the head 900 of the user the plurality of arms 300 bend downwards. This may place the plurality of massage balls 400 at positions along the base of the scalp with some pressure applied to the scalp by the plurality of massage balls 400 due to the resilience of the plurality of arms 300. In some embodiments, the plurality of arms 300 may be of non-uniform lengths—one or more subsets of the plurality of arms 300 may be shorter or longer than others of the plurality of arms 300.

The plurality of arms 300 may be coupled to the plurality of massage balls 400. Specifically, the distal end 320 of each of the plurality of arms 300 may be coupled to one of the plurality of massage balls 400. The plurality of massage balls 400 may be spherical in shape and may be constructed of a durable material. As a non-limiting example, the plurality of massage balls 400 may be made from wood or plastic.

As the proximal end 310 of the plurality of arms 300 are moved in the oscillatory motion by the vibrator 250, the distal end 320 of the plurality of arms 300 also moves. Because of the flexibility of the plurality of arms 300 the motion of the distal end 320, and therefore the motion of the plurality of massage balls 400 attached at the distal end 320, may include linear motion, circular motion, and complicated combinations thereof.

The invention 100 may be placed upon the head 900 of the user and left there or the hub 200 may be lifted above the head 900. When the hub 200 is lifted above the head 900 of the user, the plurality of massage balls 400 are raised and the resilience of the plurality of arms 300 may cause the plurality of massage balls 400 to squeeze the head 900 at a higher position, thus involving a different portion of the head 900 of the user in the massage.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may be construed to mean recharging or replacing individual cells, individual batteries of cells, or a package of multiple battery cells as is appropriate for any given battery technology that may be used.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", mean connected, either directly or indirectly and does not necessarily imply a mechanical connection.

As used herein, the word "durable" refers to a material's ability to withstand wear, pressure, impact, heat, cold, sun exposure, and other forms of potentially damaging conditions without suffering any significant deterioration of quality or value.

As used in this disclosure, an "electric motor" is a device that converts electric energy into rotational mechanical energy.

As used in this disclosure, "flexible" refers to an object or material that will deform when a force is applied to it but that will not necessarily return to its original shape when the deforming force is removed. As used herein, "resilient" refers to an object that will return to its original shape after being bent, compressed, flexed, or stretched.

As used in this disclosure, a "housing" is a rigid casing that encloses and protects one or more devices.

As used in this disclosure, a "massage" is a therapeutic process wherein the muscles of the body are kneaded for the purpose of aiding circulation and relaxing the muscles.

As used herein, "oscillatory" or "vibratory" refer to a rhythmic or repetitious motion.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A scalp massager comprising:

a hub, a plurality of arms, and a plurality of massage balls;

wherein the hub produces an oscillatory motion of the plurality of massage balls located at the ends of the plurality of arms;

wherein the scalp massager is adapted to be placed on a head of a user and the oscillatory motion of the plurality of massage balls helps relieve stress and improves circulation;

wherein the hub comprises a housing, an electric motor, a control dial, a vibrator, and one or more batteries;

wherein the hub lies at the center of the scalp massager with the plurality of arms extending radially from the side of the hub at the bottom of the housing;

wherein the hub is intended to be placed on the top, center of the head;

wherein the electric motor converts electrical energy provided by the one or more batteries into a rotary motion of a motor shaft when the electric motor is energized;

wherein the motor shaft is coupled to the vibrator;

wherein the electric motor is energized when the control dial is moved from an off position to an on position;

wherein the electric motor is de-energized when the control dial is moved from the on position to the off position;

wherein a proximal end of each of the plurality of arms is pivotally coupled to the vibrator;

wherein the vibrator translates rotary motion of the motor shaft into the oscillatory motion of the plurality of massage balls by moving the proximal end of the plurality of arms;

wherein the vibrator moves the proximal end of each of the plurality of arms by lifting the proximal end up, dropping the proximal end down; and wherein the plurality of arms form a circular arrangement with respect to the housing.

2. The scalp massager according to claim 1 wherein the housing is a protective cover for the electric motor, the vibrator, and the one or more batteries which are coupled to the inside of the housing.

3. The scalp massager according to claim 2 wherein the on position of the control dial is subdivided into a plurality of speed settings.

4. The scalp massager according to claim 2 wherein the electric motor comprises a timer circuit that causes the electric motor to be de-energized at the end of a predetermined interval;

wherein the predetermined interval begins when the control dial is moved from the off position to the on position.

5. The scalp massager according to claim 2 wherein the one or more batteries provide electrical energy used to power the electric motor;

wherein the one or more batteries are mounted within the housing.

6. The scalp massager according to claim 5 wherein the one or more batteries are accessible via a battery compartment door to allow replacement of the one or more batteries.

7. The scalp massager according to claim 5 wherein the one or more batteries are rechargeable.

8. The scalp massager according to claim 7 wherein the plurality of arms are flexible and resilient rods that couple at the proximal end to the vibrator and at a distal end to the plurality of massage balls.

9. The scalp massager according to claim 8 wherein each of the plurality of arms comprises a bend such that, when the hub is in use, the plurality of arms bend downwards;

wherein the bend places the plurality of massage balls at positions along the base of the scalp with some pressure applied to the scalp by the plurality of massage balls due to the resilience of the plurality of arms.

10. The scalp massager according to claim 9 wherein the plurality of arms are of non-uniform lengths.

11. The scalp massager according to claim 9 wherein the plurality of arms are coupled to the plurality of massage balls;

wherein the distal end of each of the plurality of arms is coupled to one of the plurality of massage balls;

wherein the plurality of massage balls are spherical in shape and are constructed of a durable material.

12. The scalp massager according to claim 11 wherein the plurality of massage balls are made from wood or plastic.

13. The scalp massager according to claim 11 wherein the oscillatory motion of the proximal end of the plurality of arms by the vibrator causes the distal end of the plurality of arms to move;

wherein the flexibility of the plurality of arms causes the distal end of the plurality of arms and the plurality of massage balls attached at the distal end to move with linear motion, circular motion, and combinations thereof.

14. The scalp massager according to claim 13 wherein the scalp massager is adapted to be placed upon the head of the user and left there without being touched.

15. The scalp massager according to claim 13 wherein the scalp massager is adapted to be lifted above the head of the user;

wherein, when the hub is lifted, the plurality of massage balls are raised and the resilience of the plurality of arms causes the plurality of massage balls to squeeze the head at a higher position.

* * * * *